US006786270B2

(12) United States Patent
Wen et al.

(10) Patent No.: US 6,786,270 B2
(45) Date of Patent: Sep. 7, 2004

(54) LIFT LOCK FOR BLIND

(75) Inventors: Yu-Che Wen, Taoyuan (TW); Yuh-Jia Ju, Hsinchu (TW)

(73) Assignees: Industrial Technology Research Institute, Hsinchu Hsien (TW); Nien Made Enterprise Co., Ltd., Chang Hua Hsien (TW)

( * ) Notice: Subject to any disclaimer, the term of this patent is extended or adjusted under 35 U.S.C. 154(b) by 0 days.

(21) Appl. No.: 10/408,563

(22) Filed: Apr. 8, 2003

(65) Prior Publication Data

US 2004/0123957 A1 Jul. 1, 2004

(30) Foreign Application Priority Data

Dec. 30, 2002 (TW) ..... 91221449 U

(51) Int. Cl.[7] ..... E06B 9/322

(52) U.S. Cl. ..... 160/170; 160/178.2; 192/92; 188/67; 188/85

(58) Field of Search ..... 160/170, 171, 160/168.1 R, 173 R, 176.1 R, 177 R, 178.1 R, 178.2 R; 192/92; 188/67, 85

(56) References Cited

U.S. PATENT DOCUMENTS 3,318,289 A * 5/1967 Marynissen ..... 401/110
3,653,777 A * 4/1972 Bross ..... 401/110
5,850,863 A * 12/1998 Huang ..... 160/168.1 R

* cited by examiner

*Primary Examiner*—Blair M. Johnson
(74) *Attorney, Agent, or Firm*—Bacon & Thomas PLLC

(57) ABSTRACT

A lift lock for blind is disclosed to include a shaft pivoted to a headrail of a blind for synchronous rotation with a lift rod of the blind. The shaft has a constraint device. A switching mechanism is mounted inside the headrail of the blind and has a sliding member movable between a locking position and an unlocking position. The sliding member has an engagement device, which engages the constraint device to stop the shaft from rotary motion when the sliding member moved to the locking position, or is disengaged from the constraint device for enabling the shaft to be rotated with the lift rod when the sliding member moved to the unlocking position. And, a control mechanism has a pull rod for pulling by the user to switch the switching mechanism between the locking position and the unlocking position.

7 Claims, 7 Drawing Sheets

LIFT LOCK FOR BLIND

BACKGROUND OF THE INVENTION

1. Field of the Invention

The present invention relates generally to blinds and, more specifically, to a lift lock used in a blind to lock the lift rod.

2. Description of the Related Art

Conventional vertically adjustable blinds are numerous, including Venetian blinds, Roller blinds, Pleated blinds, Honeycomb shades, Roman blinds, and etc. An adjustable blind generally comprises a headrail fixedly fastened to the top of the window, a bottom rail spaced below the headrail, a blind body (formed of a set of blind slats, a piece or curtain, or pleated slats) connected between the headrail and the bottom rail, and a lift cord suspended from the headrail at one lateral side for pulling by hand to lift or lower the bottom rail and the blind body. There are motor-driven blinds that use a motor drive to lift/lower the bottom rail. Because the suspending part of the lift cord is exposed to the outside of the headrail and easily accessible by a child, the suspending part of the lift cord may be hung on a child's head accidentally. In order to eliminate this problem, blinds with hidden lift cord are disclosed. A blind with hidden lift cord comprises a lift rod fastened pivotally with the inside of the headrail, and at least one spring member (normally, torsional spring) mounted inside the headrail and coupled to the lift rod. The lift rod can be rotated clockwise or counter-clockwise to roll up or let off the lift cord, so as to further lift or lower the bottom rail of the blind. The spring power of the spring member bears the weight of the bottom rail as well as the blind slats and is maintained in balance with the torque of the lift rod, enabling the blind to be positioned in the desired extending position. During operation, the user needs only to give an upward or downward pressure to break the balance.

The aforesaid structure of using the spring power of a spring member to support the lift rod at the desired elevation is functional. However, this design still has drawback. One drawback is the difficulty of accurately controlling the spring power of the spring member during installation (The size of a blind may have to be adjusted subject to the size of the window in which the blind is to be installed). Another drawback of this design is that the spring power of the spring member deteriorates with the use of the blind. When the spring power of the spring member changed, the blind tends to be lowered slightly after pulled to the desired elevation, and the touch of a small (unexpected) external force may cause the blind to lift or lower the bottom rail for a distance.

Therefore, it is desirable to provide a lift lock for blind that eliminates the aforesaid drawbacks.

SUMMARY OF THE INVENTION

It is the main object of the present invention to provide a lift lock for blind, which enables the user to control the elevation of the blind body conveniently and accurately without the use of an exposed pull cord and, which accurately locks the blind body in position when adjusted.

To achieve this object of the present invention, the lift lock for blind comprises a shaft fastened pivotally with the inside of a headrail of a blind for synchronous rotation with a lift rod of the blind. The shaft has a constraint device. A switching mechanism is mounted inside the headrail of the blind and has a sliding member movable between a locking position and an unlocking position. The sliding member includes an engagement device, which is forced into engagement with the constraint device to stop the shaft from rotary motion when the sliding member moved to the locking position, or disengaged from the constraint device for enabling the shaft to be rotated by an external force when the sliding member moved to the unlocking position. A control mechanism has a vertical pull rod provided with a top end suspended from one end of the headrail and coupled to the switching mechanism for pulling downwardly by the user to switch the switching mechanism between the locking position and the unlocking position alternatively. And, a return spring is mounted in the headrail and adapted to return the pull rod each time the pull rod been pulled downwards by the user and released.

DETAILED DESCRIPTION OF THE INVENTION

Figure 1:
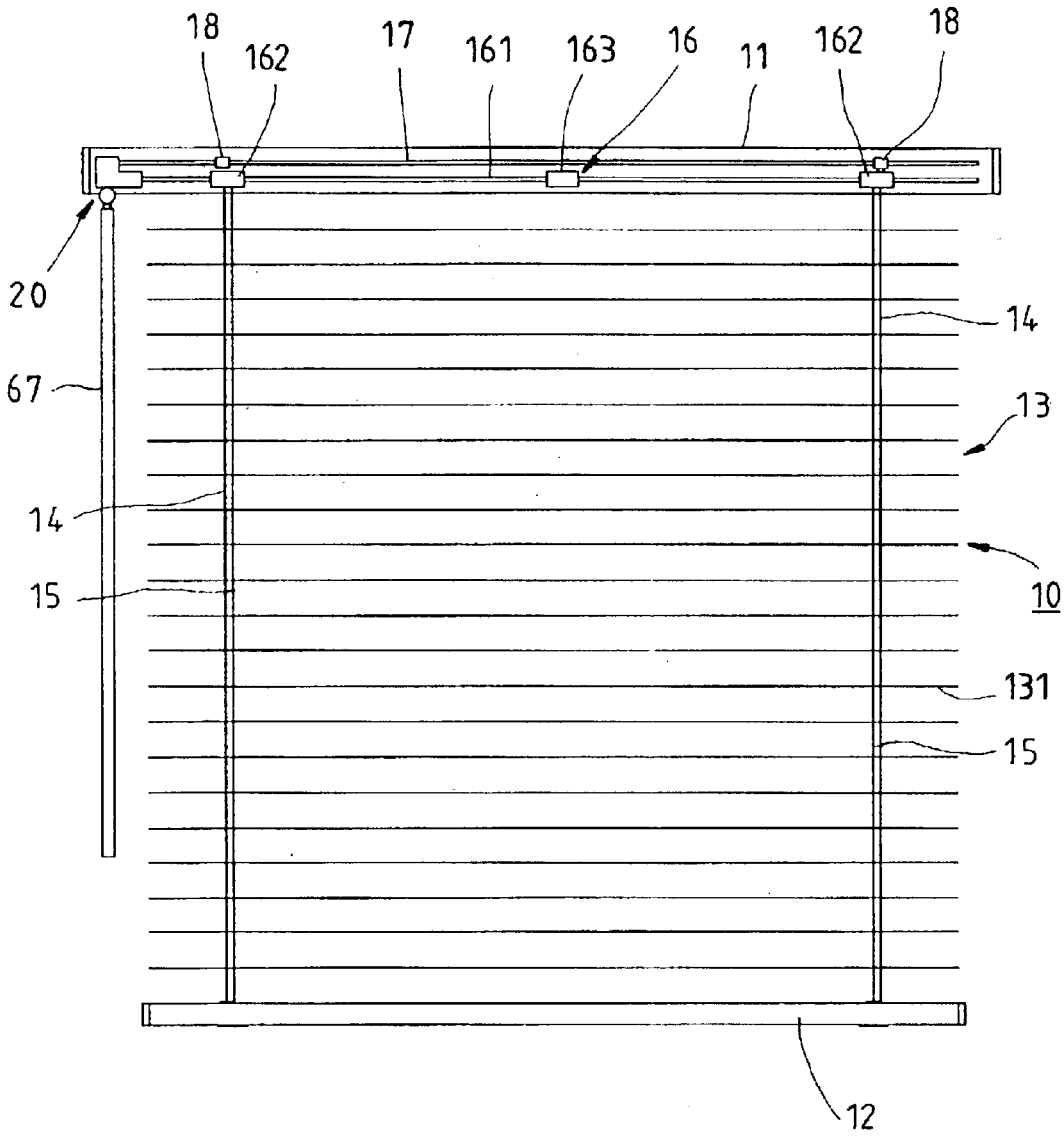
FIG. 1 illustrates a lift lock installed in a blind according to a preferred embodiment of the present invention.
Figure 2:
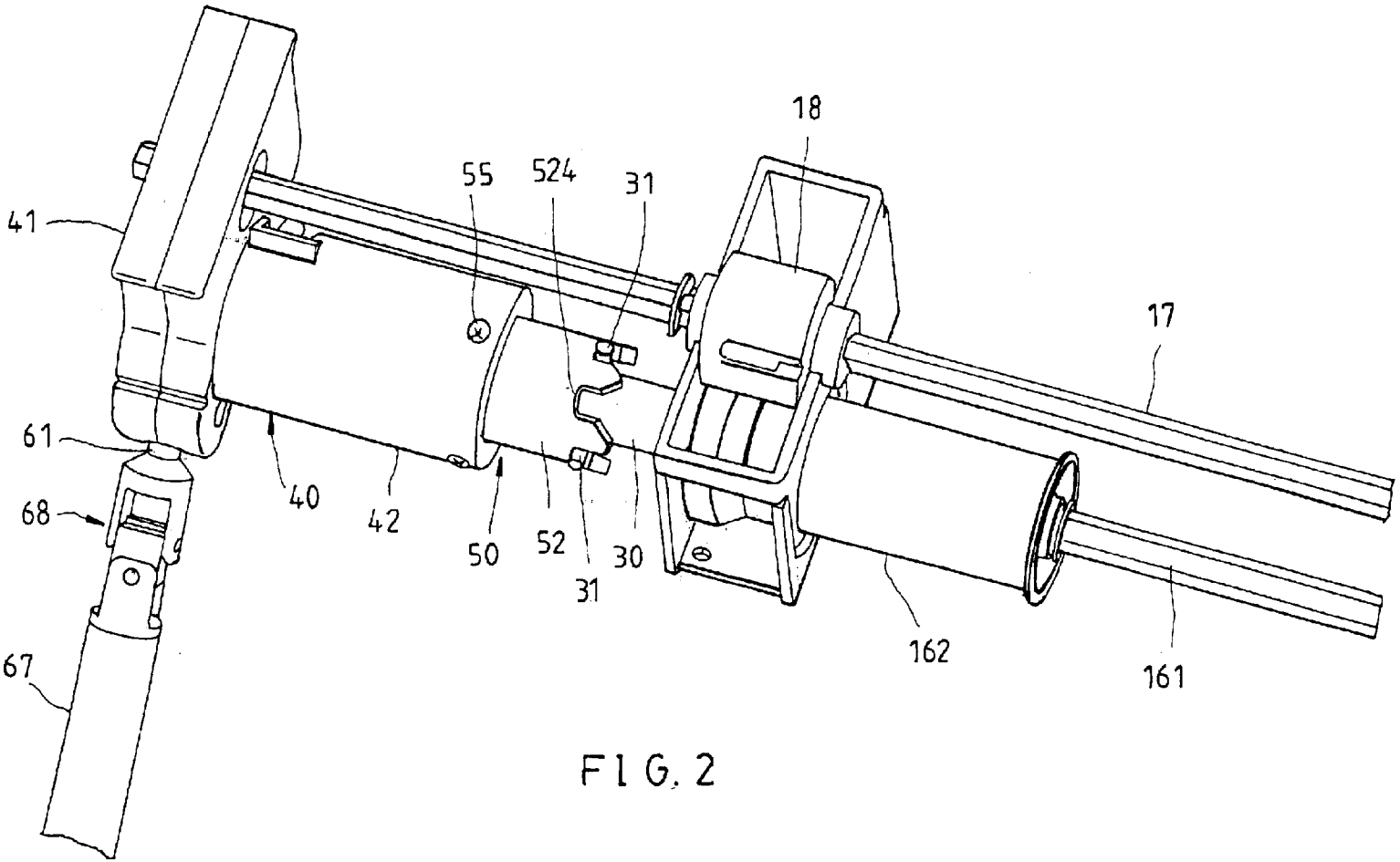
FIG. 2 is a perspective assembly view of the lift lock according to the preferred embodiment of the present invention.

As shown in FIG. 1, a lift lock 20 is shown installed in a Venetian blind 10. The Venetian blind 10 comprises a headrail 11 formed of a rectangular hollow frame bar and fixedly fastened to the top side of a window, a bottom rail 12 suspended below the headrail 11, a blind body 13 formed of a number of slats 131 arranged in parallel between the headrail 11 and the bottom rail 12, two ladder tapes 14 bilaterally connected between the headrail 11 and the bottom rail 12 to join the slats 131, two lift cords 15 vertically inserted through the slats 131 and arranged in parallel each having a bottom end fixedly fastened to the bottom rail 12 and a top end inserted into the inside of the headrail 11 (this will be described further), a spring winding mechanism 16, which comprises a horizontal lift rod 161 fastened pivotally with the inside of the headrail 11, two bobbins 162 fixedly mounted on the lift rod 161 and adapted to roll up or let off the lift cords 15 upon clockwise/counter-clockwise rotation of the lift rod 161, and a spring member 163 mounted on the middle of the lift rod 161 inside the headrail 11 and imparting a biasing force to the lift rod 161, a tilt rod 17 fastened pivotally with the inside of the headrail 11 and arranged in parallel to the lift rod 161 at a relatively higher elevation, two drums 18 fixedly mounted on the tilt rod 17 and respectively coupled to the ladder tapes 14 for moving the ladder tapes 14 to adjust the tilting angle of the slats 14 when the tilt rod 17 biased. (The aforesaid Venetian structure is of the known art.)

The lift lock 20 is installed in the left side of the Venetian blind 10 with the major part received inside the left end of the headrail 11. As illustrated in FIGS. 2~5, the lift lock 20 is comprised of a shaft 30, a casing 40, a switching mechanism 50, a control mechanism 60.

Figure 4:
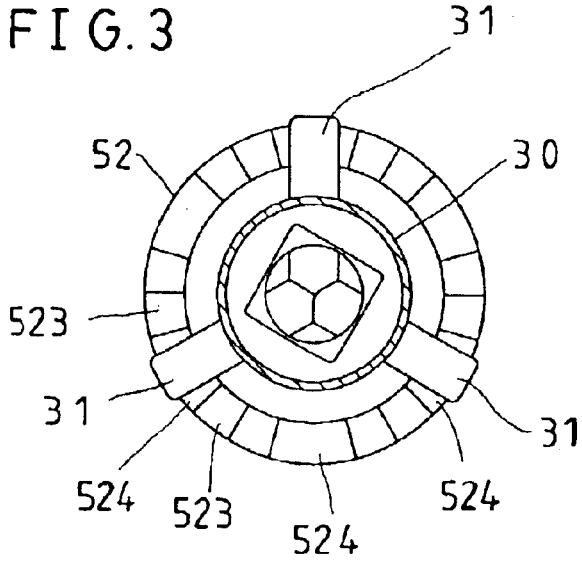
FIG. 4 is a sectional view taken along line 4—4 of FIG. 3.

The shaft 30 is suspended inside the left end of the headrail 11 and coaxially connected to the left end of the lift rod 161 for synchronous rotation (basically, the shaft 30 and the lift rod 161 are regarded as on integrated rod member), having three pegs 31 equiangularly spaced around the periphery of the left end thereof (see FIG. 4). The pegs 31 form a constraint device 32.

The casing 40 is fixedly mounted in the left end of the headrail 11 and spaced from the left end of the shaft 30 at a distance, comprising a box shell 41, a barrel shell 42 extended from the right side of the left box shell 41, a first rolling pin 43, and a second rolling pin 44.

Figure 3:
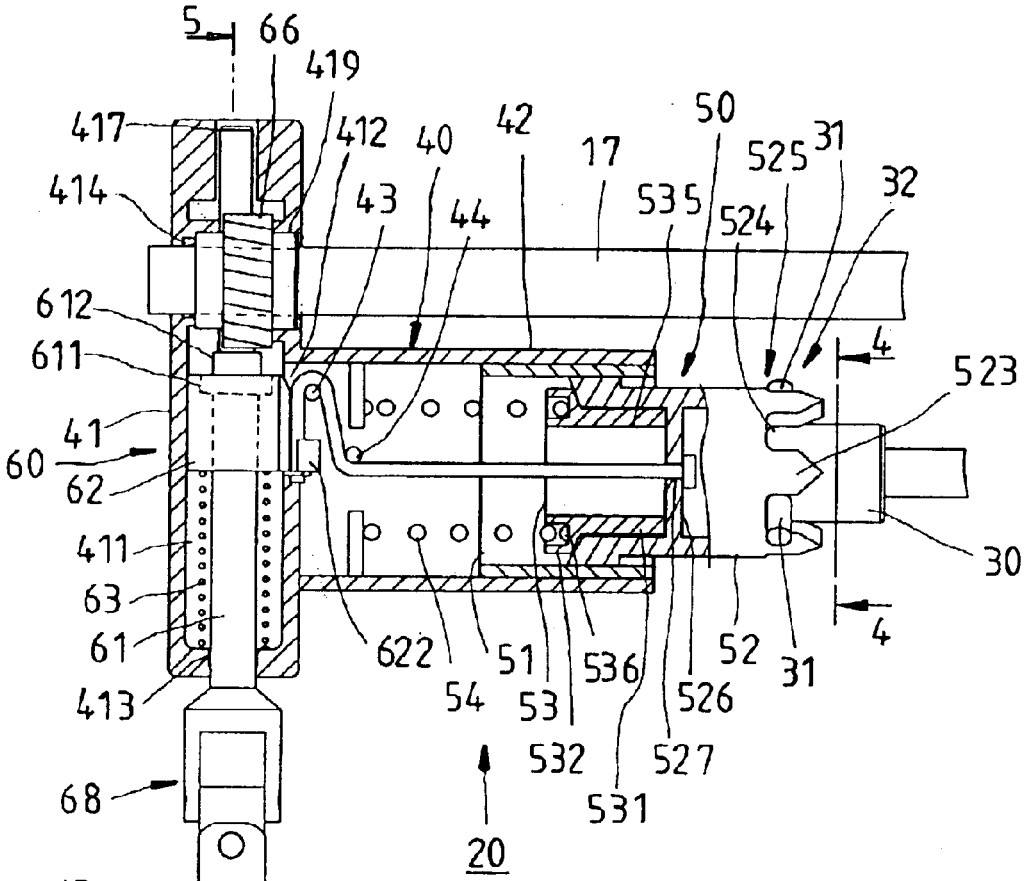
FIG. 3 is a front view in section of the lift lock according to the preferred embodiment of the present invention.
Figure 5:
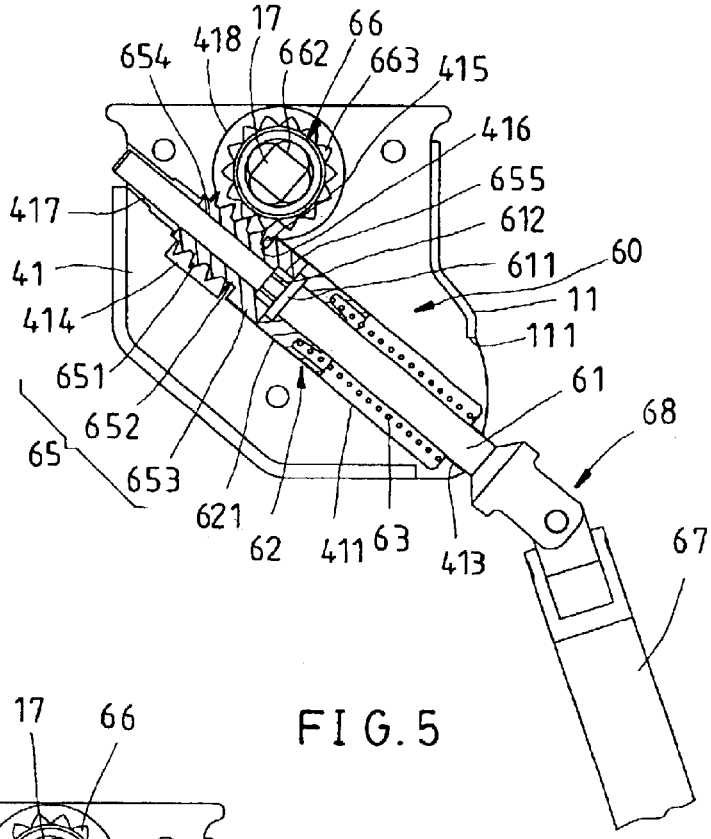
FIG. 5 is a sectional view taken along line 5—5 of FIG. 3 showing the pull rod not pulled.

As illustrated in FIG. 5, the box shell 41 fits the inside wall of the headrail 11, having a part (the lower right part) extending out of a front bottom opening 111 of the headrail 11, an elongated chamber 411 obliquely extended from the lower front side to the upper rear side, a wall hole 412 extended from the right side of the elongated chamber 411 to the right side of the box shell 41 (see FIG. 3), a small bottom pivot hole 413 extended from the bottom side of the elongated chamber 411 to the bottom side of the box shell 41, a worm chamber 414 at the top of the elongated chamber 411, a partition plate 415 disposed between the elongated chamber 411 and the worm chamber 414, a through hole 416 in the partition plate 415 in communication between the elongated chamber 411 and the worm chamber 414, a small top pivot hole 417 extended from the top side of the worm chamber 414 to the upper rear side of the box shell 41, a circular worm gear chamber 418 obliquely extended from the top side of the worm chamber 414 at one side, and a round hole 419 axially extended through the left and right side of the box shell 41 and the center of the worm chamber 418 (see FIG. 3).

Referring to FIG. 3, the barrel shell 42 is a hollow cylindrical shell axially extended from the right side of the box shell 41 around the wall hole 412 in communication with the elongated chamber 411, and axially aimed at the shaft 30. The right end (the end remote from the box shell 41) of the barrel shell 42 is an open end.

The first rolling pin 43 and the second rolling pin 44 are fastened pivotally with the inside of the barrel shell 42 near the left end and arranged in parallel. The axial direction of the rolling pins 43 and 44 are perpendicular to the axial direction of the barrel shell 42 and the longitudinal direction of the elongated chamber 411. The first rolling pin 43 is disposed near the periphery of the barrel shell 42 and facing the top side of the elongated chamber 411. The second rolling pin 44 is at the center of the barrel shell 42 corresponding to the mid point of the elongated chamber 411.

Referring to FIG. 3 again, the switching mechanism 50 is installed in the barrel shell 42 of the casing 40, comprised of a fixed member 51, a sliding member 52, a rotating member 53, and a push spring 54.

Figure 6:
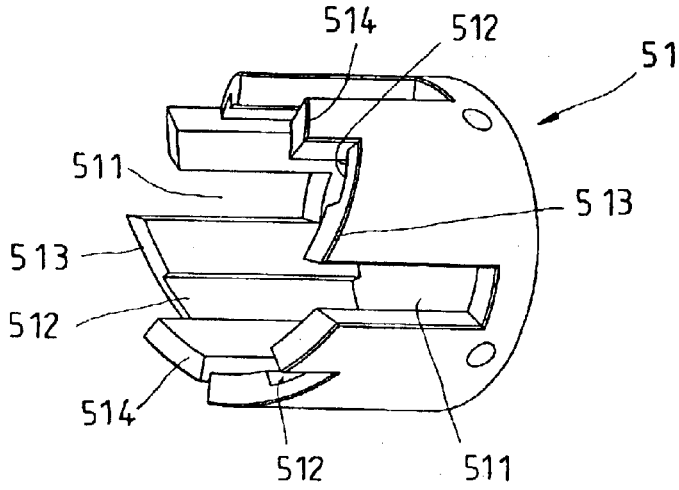
FIG. 6 is a perspective view of the fixed member according to the preferred embodiment of the present invention.

Referring to FIG. 6, the fixed member 51 is a tubular member having an outer diameter smaller than the inner diameter of the barrel shell 42 and a length shorter than the barrel shell 42. The fixed member 51 is fixedly fastened to the inside the barrel shell 42 with screws 55 and kept in flush with the right end of the barrel shell 42, having four first longitudinal guide grooves 511 extended from the left end toward the right end and spaced from the right end at a distance, and four second longitudinal guide grooves 512 extended from the left end to the right end. The first longitudinal guide grooves 511 and the second longitudinal guide grooves 512 are alternatively arranged around the periphery of the fixed member 51 and equiangularly spaced from one another (at a pitch of 45°). The radial depth of the second longitudinal guide grooves 512 from the inner surface of the fixed member 51 toward the outer surface of the fixed member 51 is less than the radial depth of the first longitudinal guide grooves 511 from the inner surface of the fixed member 51 toward the outer surface of the fixed member 51 (according to this embodiment, the first longitudinal guide grooves 511 pierced the peripheral wall of the fixed member 51; alternatively, the first longitudinal guide grooves 511 can be made without piercing the peripheral wall of the fixed member 51). The fixed member 51 further comprises a plurality of first sloping edges 513 equiangularly spaced at the left end and respectively downwardly sloping from the left end of each first longitudinal guide groove 511 to the left end of the corresponding adjacent second longitudinal guide groove 512 at one side, and a plurality of second sloping edges 514 equiangularly spaced at the left end and respectively downwardly sloping from the left side toward the right side between each second longitudinal guide groove 512 and the corresponding right-sided first longitudinal guide groove 511.

Figure 7:
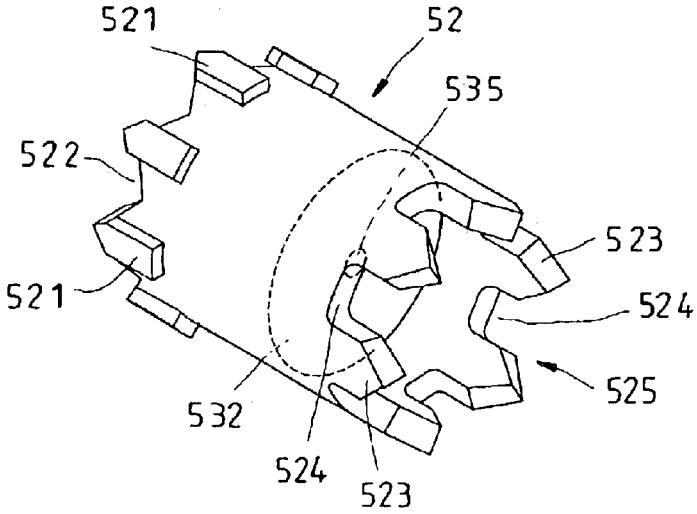
FIG. 7 is a perspective view of the sliding member according to the preferred embodiment of the present invention.

Referring to FIG. 7, the sliding member 52 is a tubular member having an outer diameter slightly smaller than the inner diameter of the fixed member 51. The sliding member 52 is coaxially received in the fixed member 51, having eight guide blocks 521 equiangularly spaced around the periphery of the left end thereof and respectively set in the longitudinal guide grooves 511 and 512 of the fixed member 51 for enabling the sliding member 52 to be moved axially relative to the fixed member 51 and prohibited from rotary motion, a plurality of triangular end notches 522 equiangularly spaced in the left end between each two adjacent guide blocks 521, each triangular end notch 522 having two sloping sides respectively downwardly sloping from the center of the left end of the corresponding two adjacent guide blocks 522 to the mid point between the corresponding two adjacent guide blocks 522, an engagement device 525 formed in the right end and extended out of the right end of the fixed member 51, a radial inside partition wall 526 on the middle, and a wire hole 527 through the center of the radial inside partition wall 526. The engagement device 525 is comprised of 6 retaining teeth 523 and 6 retaining notches 524 alternatively disposed in the right end of the sliding member 52.

Figure 8:
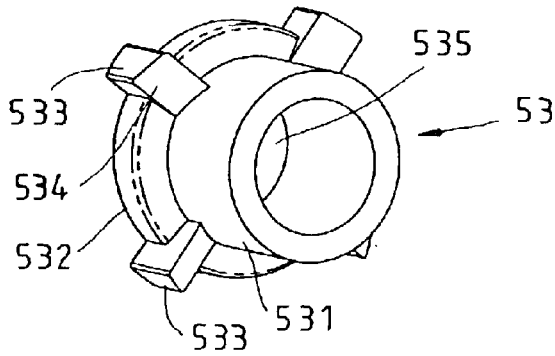
FIG. 8 is a perspective view of the rotating member according to the preferred embodiment of the present invention.

Referring to FIG. 8, the rotating member 53 comprises, a barrel 531 of outer diameter slightly smaller than the inner diameter of the sliding member 52, a circular base 532 located on the left end of the barrel 531 and having an outer diameter relatively greater than the outer diameter of the barrel 531 but slightly smaller than the inner diameter of the fixed member 51, four radial blocks 533 equiangularly spaced in the left end and protruding over the periphery of the circular base 532, an annular groove 536 in the left side of the circular base 532, and an axial center through hole 535 defined within the barrel 531 and extended through the center of the circular base 532. The radius between the axial center of the rotating member 53 and the outer end of each radial block 533 is greater than the common axis of the fixed member 51 and the rotating member 53 and the bottom side of each second longitudinal guide groove 512 of the rotating member 53, i.e., the radial blocks 533 can simultaneously be inserted into four first longitudinal guide grooves 511 of the fixed member 51 but cannot simultaneously be inserted into the second longitudinal guide grooves 512. Each radial block 533 has a right side extended from the circular base 532 to the barrel 531, forming a sloping face 534. The sloping direction of the sloping faces 534 of the radial blocks 533 corresponds to the first and second sloping edges 513 and 514 of the fixed member 51. The barrel 531 is inserted into the inside of the sliding member 52 in direction from the left side toward the right side, for enabling the rotating member 53 to be moved axially and rotated relative to the sliding member 52 and the fixed member 51.

Referring to FIG. 3 again, the push spring 54 is disposed at the left side of the rotating member 53, having one end, namely, the left end stopped at the left end of the barrel shell 42 (the right side of the box shell 41) and the other end, namely, the right end stopped at the right end of the rotating member 53 (engaged into the annular groove 536). The push spring 54 pushes the rotating member 53 rightwards without interfering with the rotating action of the rotating member 53.

Referring to FIG. 5, the control mechanism 60 is comprised of a follower rod 61, an actuating member 62, a return spring 63, a cord member 64, a worm 65, a worm gear 66, and a pull rod 67.

The follower rod 61 is mounted in the box shell 41 and inserted through the worm chamber 414, the through hole 416, and the elongated chamber 411, having two distal ends respectively pivotally inserted into the top pivot hole 417 and the bottom pivot hole 413 (the bottom end of the follower rod 61 extends out of the box shell 41) for free axial movement and rotation. The follower rod 61 has a circular stop flange 611 extended around the periphery on the middle, and a hexagonal coupling flange 612 extended around the periphery and located on the top side of the circular stop flange 611.

The actuating member 62 comprises a coupling portion 621 sleeved onto the follower rod 61 and stopped at the bottom side of the stop flange 611, and a protruding portion 622 inserted into the wall hole 412 at the right side of the elongated chamber 411 for enabling the actuating member 62 to be moved axially and prohibited from rotary motion.

The return spring 63, is sleeved on the lower half section of the follower rod 61, having a bottom end stopped at the bottom side of the elongated chamber 411 and a top end stopped at the bottom side of the actuating member 62.

The cord member 64 has a first end fixedly fastened to the protruding portion 622 of the actuating member 62, and a second end extended upwards in the barrel shell 42 over the top side of the first rolling pin 43 and then extended downwards over the bottom side of the second rolling pin 44 and then extended horizontally rightwards through the axial center of the push spring 54 and the axial center through hole 535 of the rotating member 53 and the wire hole 527 of the sliding member 52 and finally fixedly fastened to the right side of the radial inside partition wall 526 of the fixed member 52.

The worm 65 comprises a worm body 651, a barrel-like locating portion 653, a neck 652 coaxially connected to between the worm body 651 and the locating portion 653, an axial center through hole 654 axially extended through the worm body 651, the neck 652 and the barrel-like locating portion 653, and a hexagonal coupling recess 655 in the distal end of the barrel-like locating portion 653 around the axial center through hole 654. By means of the axial center through hole 654, the worm 65 is sleeved onto the upper half section of the follower rod 61. When the worm 65 mounted onto the follower rod 61, the worm body 651 is set in the worm chamber 414, the neck 652 is pivoted to the through hole 416 of the box shell 41, and the barrel-like locating portion 653 is fastened to the partition plate 415 of the box shell 41, and therefore the worm 65 can be rotated without axial displacement. The hexagonal coupling recess 655 is adapted to accommodate the hexagonal coupling flange 612 of the follower rod 61.

The worm gear 66 comprises a tubular gear shaft 661, a rectangular coupling hole 662 axially defined in the gear shaft 661, a worm gear body 663 disposed around the periphery of the middle part of the tubular gear shaft 661. The tubular gear shaft 661 is pivoted to the round hole 419 between the left and right side of the box shell 41 to hold the worm gear body 663 inside the worm gear chamber 418 in mesh with the worm body 651 of the worm 65. Further, the aforesaid tilt rod 17 has a rectangular cross section, and the left end of the tilt rod 17 is press-fitted into the rectangular coupling hole 662 of the worm gear 66.

The pull rod 67 is vertically suspended below the bottom side of the left end of the headrail 11 (see FIG. 1), having a top end coupled to the bottom end of the follower rod 61 by a universal joint 68. The pull rod 67 has a proper length so that the user's hand is accessible to the bottom end of the pull rod 67 to pull or twist the pull rod 67.

After fully description of the structural features of the lift lock 20, the operation of the lift lock 20 is outlined hereinafter.

Figure 9:
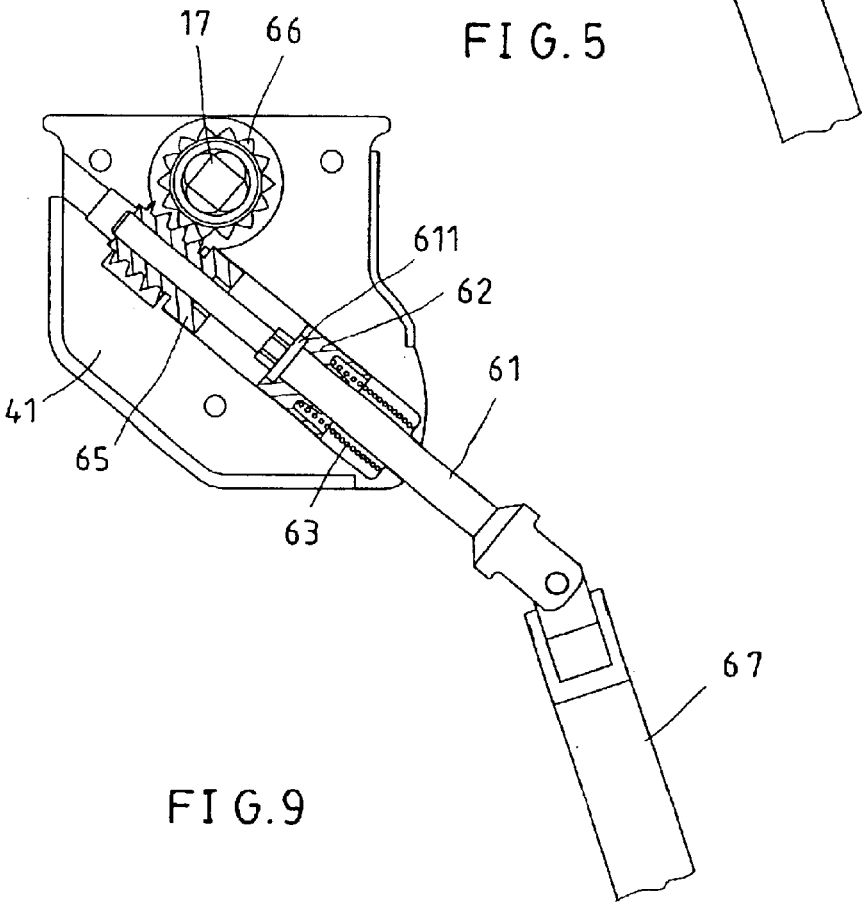
FIG. 9 is similar to FIG. 5 but showing the pull rod pulled.

Referring to FIG. 5, when the lift lock 20 receives no external force, the return spring 63 of the control mechanism 60 directly pushes the actuating member 62 against the stop flange 611 of the follower rod 61, thereby causing the follower rod 61 and the actuating member 62 to be supported in the upper limit position. When the user pulled the pull rod 67 downwards, as shown in FIG. 9, the stop flange 611 is lowered with the pull rod 67 to carry the actuating member 62 to the lower limit position. When the user released the hand from the pull rod 67 at this time, the return spring 63 immediately move the actuating member 62, the follower rod 61 and the pull rod 67 back to their respective former positions.

When the actuating member 62 lowered to the lower limit position, the first end of the cord member 64 (the end fastened to the actuating member 62) is pulled downwards, thereby the second end of the cord member 64 (the end fastened to the sliding member 52) to be pulled leftwards, i.e., when the user pulled the pull rod 67 of the control mechanism 60 downwards, the sliding member 52 of the switching mechanism 50 is moved leftwards; on the contrary, when the user released the hand from the pull rod 67, the pull force is released from the sliding member 52.

Figure 10:
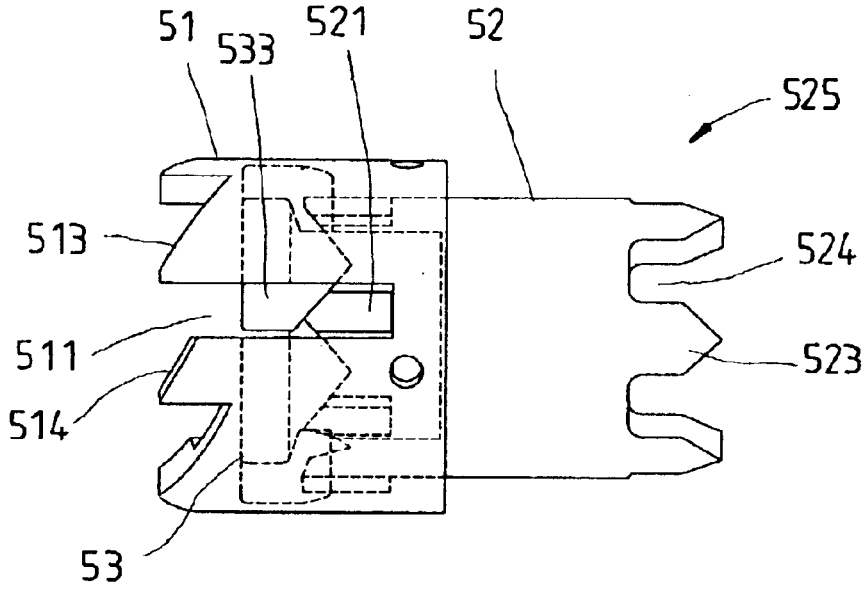
FIGS. 10~14 is a continuous series of drawings showing the switching action of the switching mechanism according to the preferred embodiment of the present invention.
Figure 12:
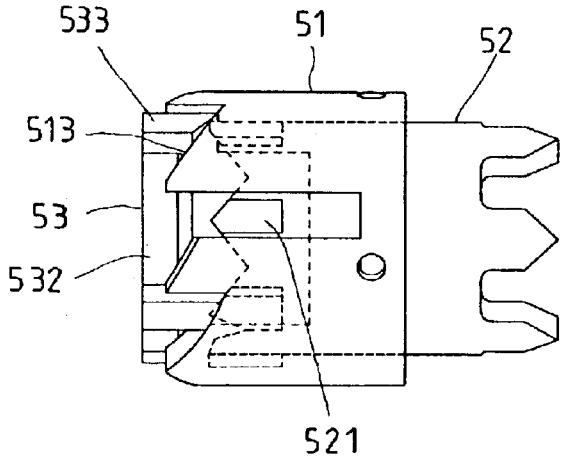

When receiving no external force, the switching mechanism is in the status shown in FIG. 10 or the status shown in FIG. 12. When the pull rod 67 pulled downwards once (and then returned by the return spring 63), the sliding member 52 is pulled leftwards (and then released), i.e., upon each stroke of the sliding member 52 (when pulled leftwards and then released), the switching mechanism 50 is switched from one status to the other.

When in the start status as shown in FIG. 10, the sliding member 52 is at the right end of its moving range (the position is called hereinafter the locking position), i.e., four of the 8 guide blocks 521 at the left end of the sliding member 52 are set into engagement with the corresponding four first longitudinal guide grooves 511 of the fixed member 51. At this time, the right end of the sliding member 52 extends to the left end of the shaft 30 to force three of the retaining notches 524 into engagement with the three pegs 31 of the shaft 30, and the rotating member 53 is stopped in the right limit position, i.e., the four radial blocks 533 of the rotating member 53 are inserted through the corresponding four first longitudinal guide grooves 511 of the fixed member 51 and stopped at the left ends of the corresponding four guide blocks 521 of the sliding member 52, and the push spring 54 supports the rotating member 53 and the sliding member 52 in position.

Figure 11:
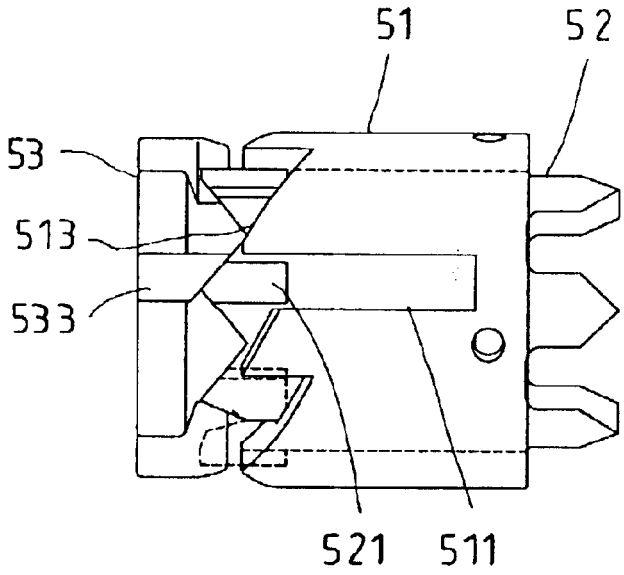

When the pull rod 67 pulled downwards from the position shown in FIG. 10, the cord member 64 is forced to pull the sliding member 52 leftwards to the left limit position as shown in FIG. 11. At this time, the guide blocks 521 of the sliding member 52 partially protrude over the left end of the fixed member 51, and the rotating member 53 is forced leftwards by the sliding member 52 to the position where the radial blocks 533 are disposed outside the left end of the fixed member 51.

Because the push spring 54 continuously pushes the rotating member 53 rightwards, the radial blocks 533 of the rotating member 53 are moved rightwards along the respective first sloping edges 513 of the fixed member 51 (see FIG. 11) into the end notches 522 of the sliding member 52 when they extended out of the first longitudinal sliding grooves 511 of the fixed member 51. When the pull rod 67 released, the leftward push force is disappeared from the sliding member 52. At this time, the rotating member 53 is forced rightwards by the push spring 54 to move the radial blocks 533 rightwards along the corresponding first sloping edges 513 as shown in FIG. 12, and the sliding member 52 is forced by the rightward moving rotating member 53 from the left limit position to the unlocking position shown in FIG. 12. Under this condition, the right end of the sliding member 52 is spaced from the left end of the shaft 30 at a distance, the engagement device 525 and the constraint device 32 (the pegs 31) do not interfere with each other.

Figure 13:
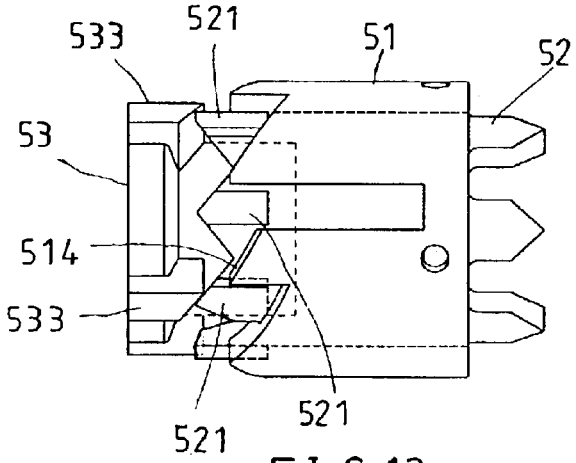

When pulling the pull rod 67 downwards from the status shown in FIG. 12, the sliding member 52 will push the rotating member 53 to the left limit position, causing the radial blocks 533 of the rotating member 53 to be moved out of the left end of the fixed member 51 as shown in FIG. 13.

Figure 14:
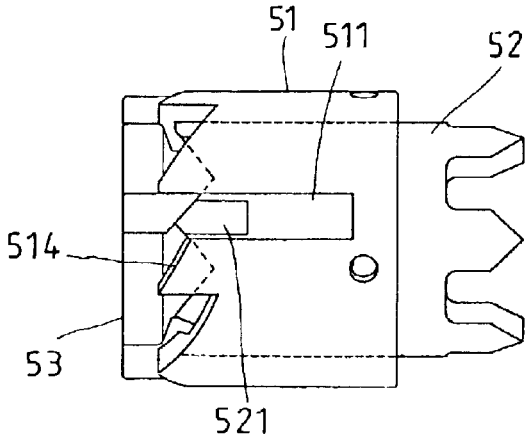

When the right sides of the radial blocks 533 of the rotating member 53 leaved from the respective left ends of the second sloping edges 514, the radial blocks 533 are immediately moved rightwards along the second sloping edges 514 to the respective left sides of the guide blocks 521. When the user released the hand from the pull rod 67 at this time, the push spring 54 immediately forces the rotating member 53 rightwards, thereby causing the radial blocks 533 to be moved along the second sloping edges 514 to the respective entries of the corresponding first longitudinal sliding grooves 511 of the fixed member 51 (to simultaneously push the guide blocks 521 of the sliding member 52 rightwards to a distance), as shown in FIG. 14. Immediately thereafter, the push spring 54 pushes the rotating member 53 and the sliding member 52 to the right limit position, returning to the status shown in FIG. 10.

As described above, when wishing to adjust the elevation of the blind body 13 of the Venetian blind 10, the user can pull the pull rod 67 to switch the switching mechanism 50 to the position shown in FIG. 12 (i.e., to move the sliding member 52 to the unlocking position without interfering with the rotary motion of the shaft 30), and then move the bottom rail 12 of the Venetian blind 10 to the desired elevation by hand. When the blind body 13 adjusted to the desired elevation, pull the pull rod 67 to switch the switching mechanism 50 to the position shown in FIG. 10 (i.e., to move the sliding member 52 to the locking position in engagement with the shaft 30), prohibiting the lift rod 161 from rotary motion. (Remark: as stated before, the sliding member 52 can only be moved horizontally but cannot be rotated; when the sliding member 52 moved rightwards from the unlocking position to the locking position, the retaining notches 524 may not be accurately aimed at the pegs 31 of the shaft 30, however the triangularly shaped retaining teeth 523 of the sliding member 52 automatically bias the shaft 30, causing the pegs 32 to be engaged into the corresponding retaining notches 524.)

The aforesaid control mechanism 60 also has the function of controlling the tilting angle of the slats 131 of the Venetian blind 10, i.e., the user can directly twist the pull rod 67 to rotate the follower rod 61, driving the worm 65 to rotate the worm gear 66 and the tilt rod 17, and therefore the ladder tapes 14 are driven by the tilt rod 17 to change the tilting angle of the slats 131.

The main function of the lift lock is to control the lifting of the blind body. This design can be employed to any of a variety of vertically adjustable blinds. Therefore, the tilting angle adjustment function may be eliminated (remark: eliminate the worm and the worm gear from the aforesaid embodiment;).

What is claimed is:

1. A lift lock installed in a blind having a headrail fixedly transversely mounted on a top side of a window, a blind body suspended from said headrail, a spring winding mechanism mounted in said headrail, said spring winding mechanism having at least one spring means and at least one drum, said at least one drum being horizontally rotatable in clockwise direction and counter-clockwise direction to upwardly receive/downwardly extend said blind body, the spring means of said spring winding mechanism imparting a torque in clockwise direction to said at least one drum, the lift lock comprising:

a shaft pivoted to said headrail for synchronous rotation with the at least one drum of said spring winding mechanism, said shaft having a constraint device;

a switching mechanism mounted inside said headrail, said switching mechanism having a sliding member movable between a locking position and an unlocking position, said sliding member having an engagement device, said engagement device being forced into engagement with said constraint device to stop said shaft from rotary motion when said sliding member moved to said locking position, said engagement device being disengaged from said constraint device for enabling said shaft to be rotated by an external force when said sliding member moved to said unlocking position; and a control mechanism having a vertical pull rod, said pull rod having a top end suspended from one end of said headrail and coupled to said switching mechanism for pulling downwardly by the user to switch said switching mechanism between said locking position and said unlocking position alternatively, and a return spring mounted in said headrail and adapted to return said pull rod each time said pull rod been pulled downwards by the user and released.

2. The lift lock as claimed in claim 1, wherein said constraint device comprises a plurality of pegs formed in and equiangularly spaced around the periphery of said shaft; said switching mechanism is comprised of a fixed member, said sliding member, a rotating member, and a push spring, said fixed member being coaxially aimed at said shaft and spaced from said shaft at a distance, said fixed member having a first end remote from said shaft, a second end near said shaft, a plurality of first longitudinal guide grooves and equal number of second longitudinal guide grooves respectively extended from the first end toward the second end, said first longitudinal guide grooves and said second longitudinal guide grooves being alternatively arranged around the periphery of said fixed member and equiangularly spaced from one another, the radial depth of said second longitudinal guide grooves from an inner surface of said fixed member toward an outer surface of said fixed member being less than the radial depth of said first longitudinal guide grooves, a plurality of first sloping edges equiangularly spaced at the first end of said fixed member and respectively downwardly sloping from a left end of each of said first longitudinal guide grooves to a left end of a corresponding adjacent second longitudinal guide groove at one side, and a plurality of second sloping edges equiangularly spaced at first left end of said fixed member and respectively downwardly sloping from a left side toward a right side between said second longitudinal guide grooves and said first longitudinal guide groove, said sliding member being coaxially received in said fixed member, having a first end and a second end corresponding to the first end and second end of said fixed member, a plurality of guide blocks equiangularly spaced around the periphery of the first end of said sliding member and respectively set in the first and second longitudinal guide grooves of said fixed member for enabling the sliding member to be moved axially relative to said fixed member and prohibited from rotary motion, a plurality of triangular end notches equiangularly spaced in the first end of said sliding member and alternatively separated by said guide blocks, said triangular end notches each having two sloping sides respectively downwardly sloping at two sides, and a plurality of retaining teeth and retaining notches alternatively disposed in the second end of said sliding member, said retaining teeth extending out of the second end of said fixed member, said retaining teeth and said retaining notches forming said engagement device, said rotating member comprising a barrel of outer diameter slightly smaller than the inner diameter of said sliding member, a circular base located on one end of said barrel having an outer diameter relatively greater than the outer diameter of said barrel and slightly smaller than the inner diameter of said fixed member, a plurality of radial blocks equiangularly spaced in the first end of said rotating member and protruding over the periphery of said circular base, and an axial center through hole defined within said barrel and extended through the center of said circular base, said radial blocks being simultaneously insertable into the first longitudinal guide grooves of said fixed member and prohibited from entering the second longitudinal guide grooves of said fixed member, said radial blocks each having a right side extended from said circular base to said barrel and forming a sloping face, said sloping face sloping in one direction corresponding to the first and second sloping edges of said fixed member, said push spring being mounted at an outer side of the first end of said fixed member and adapted to push said rotating member in direction from the first end of said rotating member toward the second end;

said sliding member being pulled to move said guide blocks out of the first end of said fixed member when said pull rod pulled downwards by the user.

3. The lift lock as claimed in claim 2, wherein said shaft is fastened pivotally with the inside of said headrail in horizontal and coaxially coupled to the at least one drum of said spring winding mechanism; the top end of said pull rod is connected to said sliding member through a cord member, said cord member pulling said sliding member to move horizontally when said pull rod pulled downwards by the user.

4. The lift lock as claimed in claim 3, wherein said control mechanism further comprises a follower rod mounted in said headrail and supported on said return spring for axial movement and adapted to pull said cord member when said pull rod pulled downwards by the user, said follower rod having a bottom end extended out of a bottom side of said headrail and coupled to the top end of said pull rod.

5. The lift lock as claimed in claim 4, wherein said blind is a Venetian blind, said headrail having a tilt rod horizontally pivotally mounted therein and adapted to adjust the tilting angle of slats of said blind body when biased by an external force; said control mechanism further comprises a worm coaxially coupled to a top end of said follower rod for synchronous rotation with said follower rod without axial displacement, and a worm gear coaxially coupled to one end of said tilt rod and meshed with said worm, an actuating member sleeved onto said follower rod and supported on said return spring and fastened to one end of said cord member and being downwardly movable by said follower rod without rotary motion.

6. The lift lock as claimed in claim 4, wherein the top end of said pull rod is coupled to a bottom end of said follower rod by a universal joint.

7. The lift lock as claimed in claim 5, wherein the top end of said pull rod is coupled to a bottom end of said follower rod by a universal joint.

* * * * *